US008509639B2

(12) United States Patent
Tao et al.

(10) Patent No.: US 8,509,639 B2
(45) Date of Patent: Aug. 13, 2013

(54) FIXING DEVICE, IMAGE FORMING APPARATUS, AND METHOD OF CONTROLLING FIXING DEVICE

(75) Inventors: Satoru Tao, Ibaraki (JP); Noritaka Masuda, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 380 days.

(21) Appl. No.: 13/021,074

(22) Filed: Feb. 4, 2011

(65) Prior Publication Data

US 2011/0222887 A1 Sep. 15, 2011

(30) Foreign Application Priority Data

Mar. 11, 2010 (JP) ..... 2010-054541

(51) Int. Cl.
*G03G 15/20* (2006.01)

(52) U.S. Cl.
USPC ..... 399/67; 399/68; 399/69

(58) Field of Classification Search
USPC ..... 399/67–69
See application file for complete search history.

(56) References Cited

U.S. PATENT DOCUMENTS 8,204,396 B2 * 6/2012 Hamby et al. ..... 399/67

FOREIGN PATENT DOCUMENTS

JP 2008-139724 6/2008

* cited by examiner

*Primary Examiner* — William J Royer
(74) *Attorney, Agent, or Firm* — Oblon, Spivak, McClelland, Maier & Neustadt, L.L.P.

(57) ABSTRACT

According to one embodiment, transit time taken for a recording medium passing through a nip portion to transit a predetermined distance is measured. A nip width adjusting mechanism adjusts a nip width on the basis of the transit time of the recording medium over the predetermined distance.

12 Claims, 6 Drawing Sheets

FIXING DEVICE, IMAGE FORMING APPARATUS, AND METHOD OF CONTROLLING FIXING DEVICE

CROSS-REFERENCE TO RELATED APPLICATIONS

The present application claims priority to and incorporates by reference the entire contents of Japanese Patent Application No. 2010-054541 filed in Japan on Mar. 11, 2010.

BACKGROUND OF THE INVENTION

1. Field of the Invention

The present invention relates to a fixing device that fixes a toner image on a recording medium, an image forming apparatus including the fixing device, and a method of controlling the fixing device.

2. Description of the Related Art

Electrophotographic image forming apparatuses such as copiers and printers have a fixing device that heats and fuses a toner image transferred onto a recording medium to fix the toner image on the recording medium. A belt fixing device and a roller fixing device are widely known as examples of those used in the image forming apparatuses. In the belt fixing device, a toner image on a recording medium is heated and fused by heat from a fixing belt. In the roller fixing device, a toner image on a recording medium is heated and fused by heat from a fixing roller.

For example, the belt fixing device includes a fixing belt, a pressing roller, and a pressure adjusting mechanism. The fixing belt is stretched across and supported by a plurality of rollers such as a fixing roller and a heating roller. The pressing roller is pressed against the fixing roller with the fixing belt interposed therebetween to form a nip portion. The pressure adjusting mechanism adjusts the position of the pressing roller to set the width of the nip portion. When a recording medium is passing through the nip portion between the fixing belt and the pressing roller, a toner image on the recording medium is heated and fused by heat from the fixing belt using the heating roller as the heat source, and pressure is applied to fix the toner image onto the recording medium.

In such a fixing device, the variation in the width of the nip portion (hereinafter, referred to as nip width) results in unstable fixability. The nip width varies according to, for example, the deformation of the fixing roller due to the expansion of a rubber layer of the fixing roller caused by applied heat. As the nip width varies, the amount of heat applied to a toner image on a recording medium that passes through the nip portion changes. As the result, the fixability becomes unstable. In view of this, for example, Japanese Patent Application Laid-open No. 2008-139724 discloses a conventional technology for optimizing the fixing condition by detecting a variation in the nip width.

With the conventional technology, to prevent the fixability from varying due to a deviation from the intended nip width, a variation is detected in the nip width from a change in the position of a tension roller (heating roller). The feeding speed of a recording medium or the temperature of the fixing belt is changed on the basis of the detection result.

According to the conventional technology, a variation in the nip width is detected from a change in the position of the tension roller (heating roller) based on the principles (1) to (3) as follows:

(1) The deformation of the fixing roller changes the tension of the fixing belt.

(2) A change in the tension of the fixing belt changes the position of the tension roller which can be displaced.

(3) The displacement of the tension roller is measured with a range sensor.

It is therefore not possible to detect a variation in the nip width accurately if the elastic characteristic of the fixing belt, i.e., the basis of the foregoing principle (1), changes over time. Accurate detection of a nip width variation is also not possible if the displacement characteristic of the tension roller with respect to a change in the tension of the fixing belt, i.e., the basis of the principle (2), varies. That is, the conventional technology involves mechanical characteristics which are likely to change over time to detect a variation in the nip width. Consequently, it is difficult to continue the detection of a variation in the nip width accurately.

SUMMARY OF THE INVENTION

It is an object of the present invention to at least partially solve the problems in the conventional technology.

According to an aspect of the present invention, a fixing device includes a fixing roller, a pressing member, a measuring unit, and an adjusting unit. The fixing roller is driven to rotate. The pressing member is pressed against the fixing roller to form a nip portion. The measuring unit measures transit time taken for a recording medium passing through the nip portion to transit a predetermined distance. The adjusting unit adjusts a fixing condition based on the transit time measured by the measuring unit.

According to another aspect of the present invention, an image forming apparatus includes a fixing device including a fixing roller, a pressing member, a measuring unit, and an adjusting unit. The fixing roller is driven to rotate. The pressing member is pressed against the fixing roller to form a nip portion. The measuring unit measures transit time taken for a recording medium passing through the nip portion to transit a predetermined distance. The adjusting unit adjusts a fixing condition based on the transit time measured by the measuring unit.

According to still another aspect of the present invention, there is provided a method of controlling a fixing device including a fixing roller that is driven to rotate and a pressing member that is pressed against the fixing roller to form a nip portion. The method includes: measuring transit time taken for a recording medium passing through the nip portion to transit a predetermined distance; and adjusting a fixing condition based on the transit time.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Exemplary embodiments of the present invention will be described in detail below with reference to the accompanying drawings. In the following embodiments, an image forming apparatus will be described by way of example as a tandem color laser printer, and a fixing device will be described as a belt fixing device.

Figure 1:
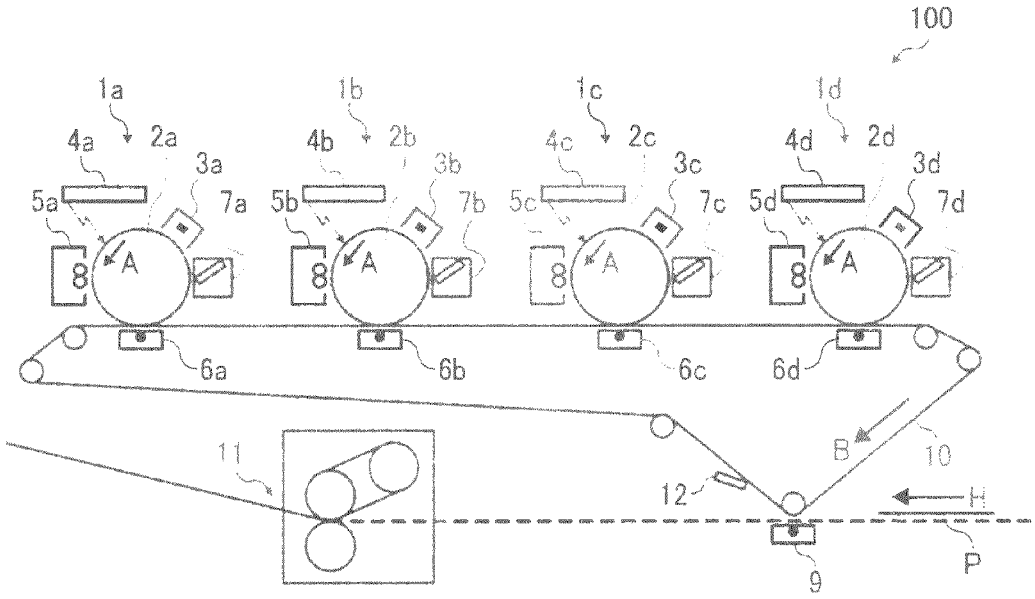
FIG. 1 is a schematic diagram of a color laser printer.

FIG. 1 is a schematic diagram showing the configuration of a color laser printer 100 according to an embodiment of the present invention. The color laser printer 100 includes image forming units 1*a*, 1*b*, 1*c*, and 1*d* for four colors Y (yellow), M (magenta), C (cyan), and K (black). The color laser printer 100 is of tandem type where the image forming units 1*a*, 1*b*, 1*c*, and 1*d* are arranged in succession along the running direction of a transfer belt 10 (the direction of the arrow B in FIG. 1).

The image forming units 1*a*, 1*b*, 1*c*, and 1*d* include photosensitive elements 2*a* to 2*d*, element charging units 3*a* to 3*d*, exposing units 4*a* to 4*d*, developing units 5*a* to 5*d*, transfer units 6*a* to 6*d*, and cleaning units 7*a* to 7*d*, respectively. The photosensitive elements 2*a* to 2*d* have a drum-like configuration and are operated to rotate in the directions of the arrows A in FIG. 1. The element charging units 3*a* to 3*d* uniformly charge the photosensitive elements 2*a* to 2*d* that are operated to rotate. The exposing units 4*a* to 4*d* scan the surfaces of the photosensitive elements 2*a* to 2*d* charged by the element charging units 3*a* to 3*d* with laser light, thereby forming electrostatic latent images based on image data. The developing units 5*a* to 5*d* develop with toner the electrostatic latent images that are formed on the photosensitive elements 2*a* to 2*d* by the exposure of the exposing units 4*a* to 4*d*. The transfer units 6*a* to 6*d* transfer the toner images formed on the photosensitive elements 2*a* to 2*d* by the development of the developing units 5*a* to 5*d* onto the transfer belt 10. The cleaning units 7*a* to 7*d* clean the surfaces of the photosensitive elements 2*a* to 2*d*.

In the color laser printer 100, the toner images of four colors Y, M, C, and K formed by the image forming units 1*a*, 1*b*, 1*c*, and 1*d* are transferred onto the transfer belt 10 in a superimposed manner, whereby a toner image in full four colors is formed on the transfer belt 10. Upon reaching a sheet transfer unit 9, the toner image formed on the transfer belt 10 is transferred onto a recording medium P by the action of high voltage applied to the sheet transfer unit 9. The recording medium P is fed in the direction of the arrow H in FIG. 1 to pass between the transfer belt 10 and the sheet transfer unit 9. Residual toner remaining on the transfer belt 10 is collected by a belt cleaning unit 12. The toner image transferred onto the recording medium P is fixed onto the recording medium P by a fixing device 11.

Figure 2:
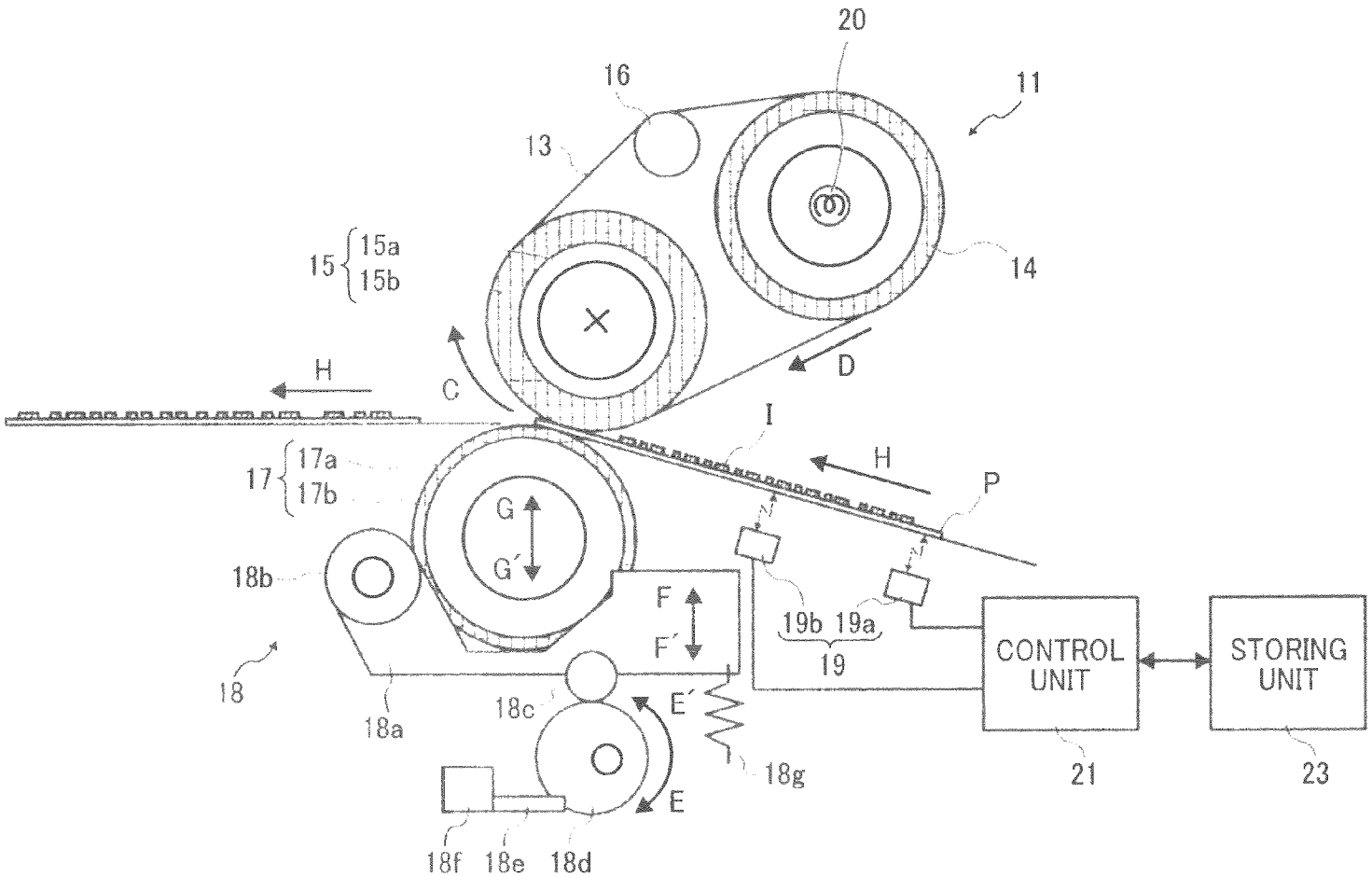
FIG. 2 is a diagram showing the detailed configuration of a fixing device.

FIG. 2 is a diagram showing the configuration of the fixing device 11 in detail. The fixing device 11 is a belt fixing device which uses a fixing belt 13 as the fixing member. Aside from the fixing belt 13, the fixing device 11 includes a heating roller 14, a fixing roller 15, a tension roller 16, a pressing roller (pressing member) 17, a nip width adjusting mechanism 18, recording medium detection sensors 19, a heater 20, and the like.

The fixing belt 13 as the fixing member is an endless belt of multilayer structure, having an elastic layer and a releasing layer successively stacked on a base layer of resin material. The elastic layer of the fixing belt 13 is made of an elastic material such as fluorine-containing rubber, silicone rubber, and foamed silicone rubber. The releasing layer of the fixing belt 13 is made of PFA (tetrafluoroethylene-perfluoroalkyl vinyl ether copolymer resin), polyimide, polyetherimide, PES (polyether sulfide), or the like. The provision of the releasing layer on the surface of the fixing belt 13 ensures releasability (detachability) of the toner image I. The fixing belt 13 is stretched across and supported by the three rollers (heating roller 14, fixing roller 15, and tension roller 16). The tension roller 16 has the role of giving a certain tension to the fixing belt 13 which is stretched across the three rollers.

The heating roller 14 is a thin cylindrical body made of a metal material. The heater 20 (heat source) is fixedly arranged inside the cylindrical body. The heater 20 is a halogen heater or carbon heater which is fixed to side plates of the fixing device 11 at both ends. The heating roller 14 is rotatably attached to the side plates of the fixing device 11 at both axial ends via bearings. The heater 20 generates heat when output-controlled power is supplied from a power supply unit (alternating-current power supply). The radiant heat from the heater 20 heats the heating roller 14, and the surface of the fixing belt 13 heated by the heating roller 14 applies heat to the toner image I on the recording medium P. The output of the heater 20 is controlled on the basis of the temperature at the belt surface, detected by a temperature sensor (not shown) such as a thermopile which is opposed to the surface of the fixing belt 13.

The fixing roller 15 has a core 15*a* made of stainless steel (for example, SUS304) or the like, on which an elastic layer 15*b* of fluorine-containing rubber, silicone rubber, foamed silicone rubber, or the like is formed. The fixing roller 15 is rotatably attached to the side plates of the fixing device 11 at both axial ends via bearings. The fixing roller 15 is driven to rotate clockwise (in the direction of the arrow C in FIG. 2) by a fixing roller driving unit (not shown) so that the fixing belt 13 runs in the direction of the arrow D in FIG. 2.

The pressing roller 17 has basically the same configuration as that of the fixing roller 15. An elastic layer 17*b* of fluorine-containing rubber, silicone rubber, foamed silicone rubber, or the like is formed on a core 17*a* made of stainless steel (for example, SUS304) or the like.

In the fixing device 11, the pressing roller 17 is pressed against and in contact with the fixing roller 15 with the fixing belt 13 interposed therebetween (via the fixing belt 13) to form a nip portion. To form the nip portion, the fixing device 11 is configured so that the elastic layer 15*b* of the fixing roller 15 is thicker than the elastic layer 17*b* of the pressing roller 17. For example, the elastic layer 17*b* of the pressing roller 17 is 3 mm and the elastic layer 15*b* of the fixing roller 15 is 15 mm in thickness.

To heat and fuse the toner image I on the recording medium P to stably fix the toner image I onto the recording medium P, the width of the nip portion (nip width) between the fixing roller 15 and the pressing roller 17 needs to be set appropriately depending on the recording medium P used. The nip width is prone to secular changes, and the fixability may vary with variations in the nip width. In the fixing device 11 according to the present embodiment, the nip width adjusting mechanism 18 is provided as a mechanism for adjusting the nip width when the nip width undergoes such a change.

The nip width adjusting mechanism 18 has a swing arm 18*a*. Bearings at both ends of the pressing roller 17 are rotatably supported by the swing arm 18*a*. The swing arm 18*a* has a swing shaft 18*b* at one end, and can make a swing about the swing shaft 18*b*. A bearing 18*c* is fixed to the other end side of the swing arm 18*a*. An eccentric cam 18*d* having a rotating shaft in an eccentric position is arranged where it makes a contact with the bearing 18*c* from below in FIG. 2. The eccentric cam 18*d* is driven by a nip width adjusting motor (not shown). The eccentric cam 18*d* is provided with a block plate 18*e*. An eccentric cam position detection unit 18*f* can detect the position of the block plate 18*e* to grasp the reference position of the eccentric cam 18*d*.

The eccentric cam 18*d* is always maintained in contact with the bearing 18*c* by the tension of a swing arm spring 18*g* which is connected to the swing arm 18*a*. When the eccentric cam 18*d* is driven by the nip width adjusting motor to rotate in the direction of the arrow E in FIG. 2, the bearing 18*c* moves in the direction of the arrow F in FIG. 2. As a result, the pressing roller 17 moves in the direction of the arrow G in FIG. 2, with an increase in the nip width. When the eccentric cam 18*d* is driven by the nip width adjusting motor to rotate in the direction of the arrow E' in FIG. 2, the bearing 18*c* moves in the direction of the arrow F' in FIG. 2. As a result, the pressing roller 17 moves in the direction of the arrow G' in FIG. 2, with a decrease in the nip width.

Two recording medium detection sensors 19*a* and 19*b* are provided on the moving path of the recording medium P that is fed to the nip portion between the fixing roller 15 and the pressing roller 17, at respective different positions on the upstream side of the nip portion. The recording medium detection sensors 19*a* and 19*b* are intended to detect the position of the trailing edge of the recording medium P when the recording medium P nipped in the nip portion is being fed through the nip portion by the rotation of the fixing roller 15. The recording medium detection sensors 19*a* and 19*b* are therefore arranged within a distance corresponding to the length (the dimension in the direction of movement) of a recording medium P of minimum size to be used in the color laser printer 100, on the upstream side of the moving path of the recording medium P from the output end of the nip portion.

Detection signals from the recording medium detection sensors 19*a* and 19*b* are input to a control unit 21. In the present embodiment, the control unit 21 calculates the time taken for the recording medium P passing through the nip portion to travel a predetermined distance (transit time) on the basis of a time difference between when the two recording medium detection sensors 19*a* and 19*b* detect the trailing edge of the recording medium P. The control unit 21 then compares the calculated transit time with base time stored in a storing unit 23. Based on the amount of change of the transit time with respect to the base time, the control unit 21 operates the nip width adjusting mechanism 18 to adjust the nip width to an appropriate value. The base time is the transit time of the recording medium P passing through the nip portion over the predetermined distance calculated by the control unit 21 when the nip portion is maintained at the appropriate value. The base time is stored in the storing unit 23 in advance.

The recording medium detection sensors 19*a* and 19*b* may be photosensors of reflection type, for example. Aside from the reflection type, photosensors of transmission type having a light-emitting part paired with a light-receiving part and other photosensors may be used for the recording medium detection sensors 19*a* and 19*b* as long as it is possible to detect the position of the trailing edge of the recording medium P. While in the present embodiment the two recording medium detection sensors 19*a* and 19*b* are arranged along the moving path of the recording medium P, three or more recording medium detection sensors 19 may be provided.

Figure 3A:
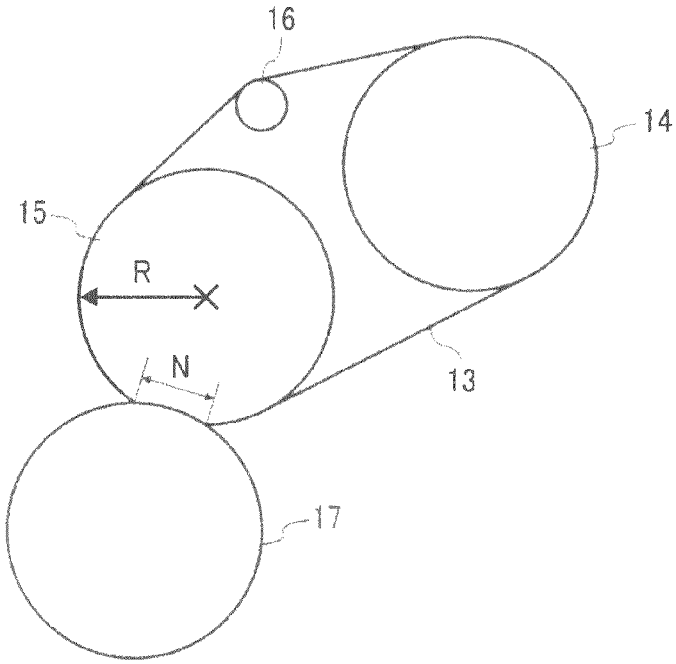
FIGS. 3A and 3B are diagrams schematically showing how the nip width varies in the fixing device.
Figure 3B:
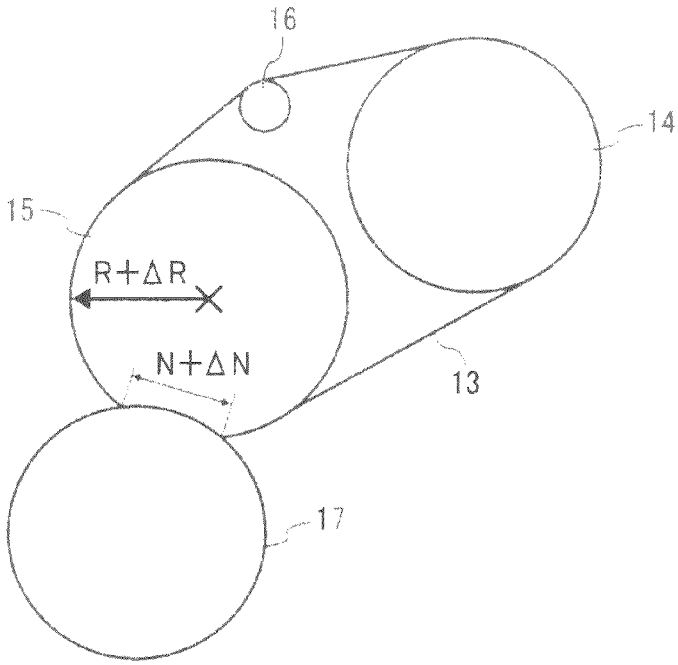

FIGS. 3A and 3B are diagrams schematically showing how the nip width varies in the fixing device 11. FIG. 3A shows the state of the fixing device 11 at the beginning of printing after the color laser printer 100 is powered on. FIG. 3B shows the state of the fixing device 11 at the end of printing of a predetermined number of sheets. When starting printing, the fixing roller 15 is relatively low in temperature. The radius of the fixing roller 15 here will be referred to as R, and the nip width N (see FIG. 3A). As the printing continues, the amount of heat the fixing roller 15 receives increases gradually. The elastic layer 15*b* of the fixing roller 15 makes a thermal expansion, and the fixing roller 15 increases to $R+\Delta R$ in radius ($\Delta R \geqq 0$). Consequently, the nip width increases to $N+\Delta N$ ($\Delta N \geqq 0$; see FIG. 3B). While the shown example has dealt with the case where the nip width varies from deformation due to the expansion of the fixing roller 15, the nip width can also vary when the position where the pressing roller 17 is pressed against the fixing roller 15 changes.

If the pressing roller 17 is kept in the same position for continuous printing despite such a change in the nip width, the amount of heat applied to the toner image I on the recording medium P in the nip portion becomes greater. This precludes favorable fixability because the toner image I on the recording medium P may adhere to the fixing belt 13, failing to be properly fixed to the recording medium P or impairing glossiness of a color image. Then, the fixing device 11 according to the present embodiment detects such a variation of the nip width in terms of a change in the transit time of the recording medium P over a predetermined distance. The nip width adjusting mechanism 18 is operated to adjust the nip width to an appropriate value so that favorable fixability can be stably obtained.

Figure 4:
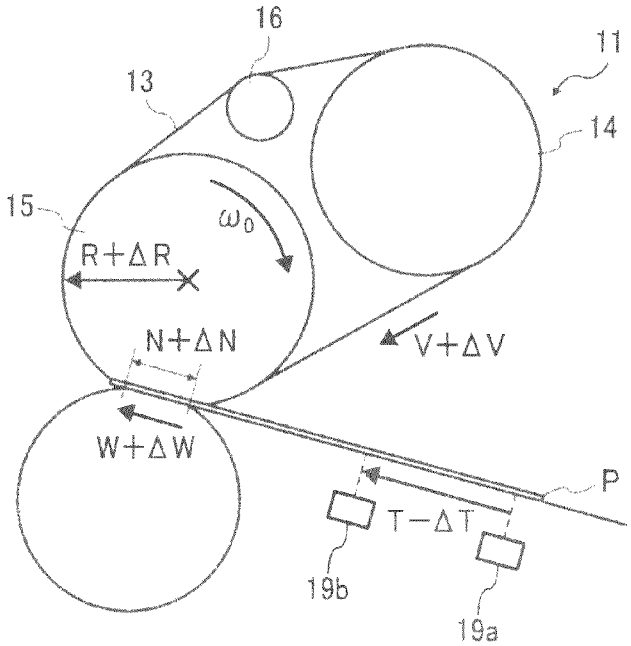
FIG. 4 is a diagram for explaining the detection of a variation in the nip width.

FIG. 4 is a diagram for explaining the detection of a variation in the nip width. The fixing roller 15 is rotated at an angular speed $\omega_0$ by a driving unit (not shown). When the fixing roller 15 thermally expands to a radius of $R+\Delta R$, the surface speed of the fixing belt 13 changes from the initial speed V to $V+\Delta V$. More specifically, the fixing belt 13 has a speed of $V+\Delta V$ at the input end of the nip portion. In the middle of the nip portion, the speed of the fixing belt is V. At the output end of the nip portion, the speed of the fixing belt is $V+\Delta V$. Consequently, with the deformation of the fixing roller 15, the feeding speed of the recording medium P that is nipped and fed by the nip portion changes from W to $W+\Delta W$ ($\Delta W \geqq 0$).

Suppose that the distance between the two recording medium detection sensors 19*a* and 19*b* is Z. When the feeding speed of the recording medium P changes from W to $W+\Delta W$ ($\Delta W \geqq 0$), the time T from when the trailing edge of the recording medium P passes the recording medium detection sensor 19*a* to when it passes the recording medium detection sensor 19*b* becomes $T-\Delta T$ ($\Delta T \approx T \cdot \Delta W/W$). That is, a change in the feeding speed of the recording medium P that is nipped and fed by the nip portion results in a change in the transit time of the recording medium P passing through the nip portion over the predetermined distance (the distance Z between the recording medium detection sensors 19*a* and 19*b*). The present embodiment uses this principle to detect a change in the time difference between when the two recording medium detection sensors 19*a* and 19*b* detect the trailing edge of the recording medium P as a variation in the nip width. The nip width adjusting mechanism 18 is operated according to the variation in the nip width, thereby adjusting the nip width to an appropriate value.

Figure 5:
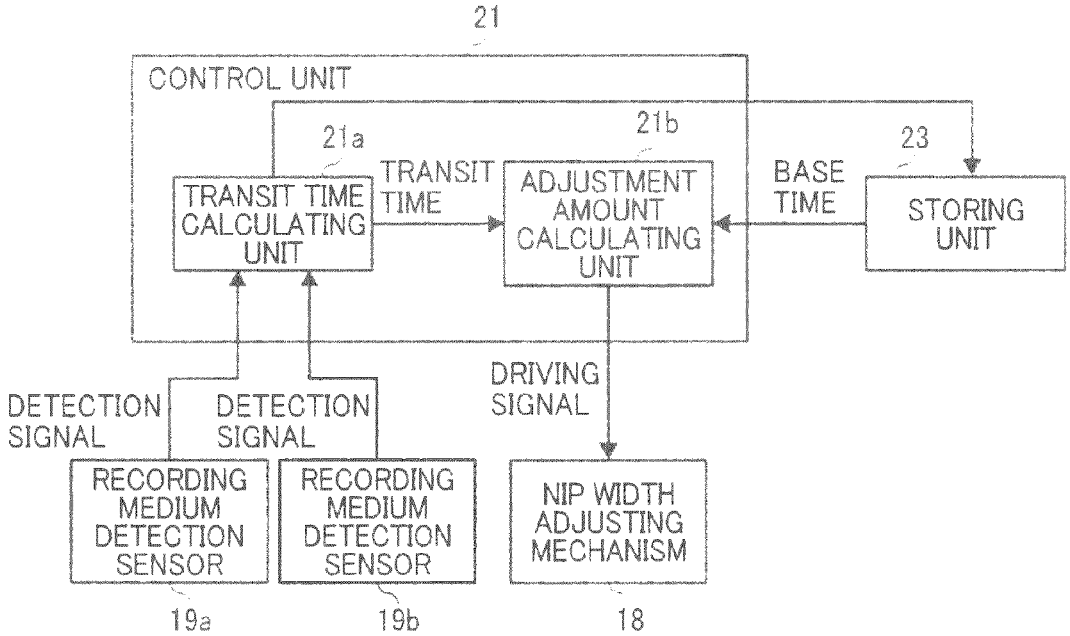
FIG. 5 is a block diagram showing the configuration of a control system for adjusting the nip width according to a variation in the nip width.

FIG. 5 is a block diagram showing the configuration of a control system for adjusting the nip width according to a variation in the nip width. The control system is composed of the recording medium detection sensors 19*a* and 19*b*, the storing unit 23, the control unit 21, and the nip width adjusting mechanism 18. In terms of functional configuration, the control unit 21 implements a transit time calculating unit 21*a* and an adjustment amount calculating unit 21*b*. The control unit 21 may include, for example, a microcomputer. The function of the transit time calculating unit 21*a* and the function of the adjustment amount calculating unit 21*b* are implemented by a central processing unit (CPU) executing a control program stored in a read-only memory (ROM) using a random-access memory (RAM) as a work area.

The transit time calculating unit 21*a* calculates the transit time of the recording medium P passing through the nip portion over the predetermined distance (the distance between the recording medium detection sensors 19*a* and 19*b*) on the basis of a time difference between when the recording medium detection sensor 19*a* detects the trailing edge of the recording medium P and when the recording medium detection sensor 19*b* detects the trailing edge of the recording medium P. The transit time calculating unit 21*a* desirably has the function of updating the base time stored in the storing unit 23 with the transit time of the recording medium P over the predetermined distance calculated after the nip width is adjusted by the nip width adjusting mechanism 18.

The adjustment amount calculating unit 21*b* calculates the amount of adjustment to be made to the nip width on the basis of a difference between the transit time of the recording medium P passing through the nip portion over the predetermined distance calculated by the transit time calculating unit 21*a* and the base time stored in the storing unit 23. The adjustment amount calculating unit 21*b* outputs a driving signal corresponding to the calculated adjustment amount to the nip width adjusting mechanism 18. The adjustment amount calculating unit 21*b* may calculate the amount of adjustment on the basis of a difference between one transit time calculated by the transit time calculating unit 21*a* and the base time. It is preferred, however, that transit times calculated by the transit time calculating unit 21*a* a predetermined number of times be averaged and the amount of adjustment be calculated on the basis of a difference between the average and the base time. As for the base time stored in the storing unit 23, it is desirable that transit times calculated by the transit time calculating unit 21*a* a predetermined number of times when the nip width is maintained at an appropriate value be averaged and stored in the storing unit 23 as the base time. This makes it possible to suppress the effect of unexpected disturbances and allow high precision adjustment of the nip width.

In the fixing device 11 according to the present embodiment described so far, the recording medium detection sensors 19*a* and 19*b* and the transit time calculating unit 21*a* of the control unit 21 correspond to the "measuring unit" set forth in the claims. The nip width adjusting mechanism 18 and the adjustment amount calculating unit 21*b* of the control unit 21 correspond to the "adjusting unit" set forth in the claims.

Figure 6:
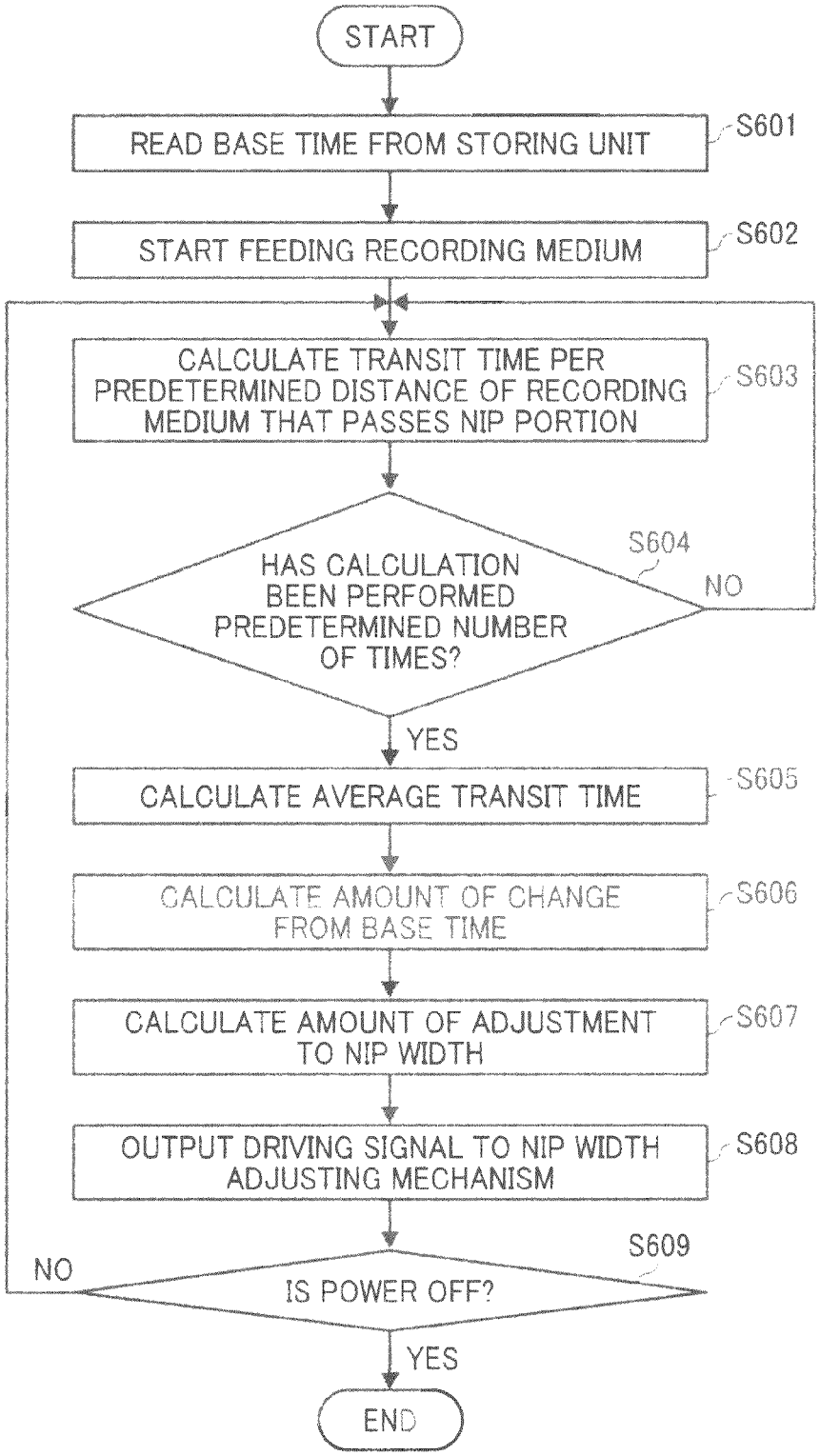
FIG. 6 is a flowchart of an example of concrete processing performed by a control unit when the fixing device is in operation.

FIG. 6 is a flowchart of an example of the concrete processing to be performed by the control unit 21 when the fixing device 11 of the present embodiment is in operation. With reference to FIG. 6, the processing performed by the control unit 21 will be described.

The processing of FIG. 6 is started when the color laser printer 100 is powered on. The control unit 21 initially reads the base time Tbase from the storing unit 23 (step S601). The control unit 21 activates the driving unit of the fixing roller 15 so that the fixing device 11 starts feeding the recording medium P on which a toner image is formed and that is fed to the fixing device 11 (step S602).

When the fixing device 11 starts feeding the recording medium P, the recording medium detection sensors 19*a* and 19*b* input their detection signals to the control unit 21 at timing when the trailing edge of the recording medium P passes the recording medium detection sensors 19*a* and 19*b* in the process of the recording medium P passing through the nip portion of the fixing device 11. The control unit 21 calculates the transit time of the recording medium P passing through the nip portion over the predetermined distance (the distance between the recording medium detection sensors 19*a* and 19*b*) on the basis of the time difference between when the recording medium detection sensors 19*a* and 19*b* detect the trailing edge of the recording medium P (step S603).

Next, the control unit 21 determines whether the transit time has been calculated at step S603 a predetermined number of times (step S604). If not (No at step S604), the control unit 21 repeats the calculation of the transit time at step S603 until the predetermined number of calculations are performed. On the other hand, if the transit time has been calculated the predetermined number of times (Yes at step S604), the control unit 21 calculates the average transit time for the predetermined number of times (step S605). For example, if the predetermined number of times is five and the transit times calculated are T1, T2, T3, T4, and T5, the average transit time Tave for the predetermined number of times is Tave=(T1+T2+T3+T4+T5)/5. The predetermined number of times may be set to one. If the predetermined number of times is set to one, the calculation of the average at step S605 is omitted.

Next, the control unit 21 calculates the amount of change Δt in the transit time of the recording medium P passing through the nip portion over the predetermined distance on the basis of a difference between the base time Tbase read at step S601 and the average Tave calculated at step S605 (Tave−Tbase) (step S606). The control unit 21 calculates the nip width adjustment amount according to the amount of change Δt calculated (step S607). The control unit 21 then outputs a driving signal corresponding to the calculated nip width adjustment amount to the nip width adjusting mechanism 18 (step S608) so that the nip width adjusting mechanism 18 makes an adjustment to the nip width. To calculate the nip width adjustment amount according to the amount of change Δt, for example, a correspondence table may be retained that defines in advance the relationship between the amount of change Δt and the amount of correction to the position of the eccentric cam 18*d* in the nip width adjusting mechanism 18. The amount of correction to the position of the eccentric cam 18*d* corresponding to the amount of change Δt can be determined based on the correspondence table.

Subsequently, the control unit 21 repeats the processing of step S603 and the subsequent steps before the color laser printer 100 is powered off (No at step S609). When the color laser printer 100 is powered off (Yes at step S609), the control unit 21 ends the series of processing.

Figure 7:
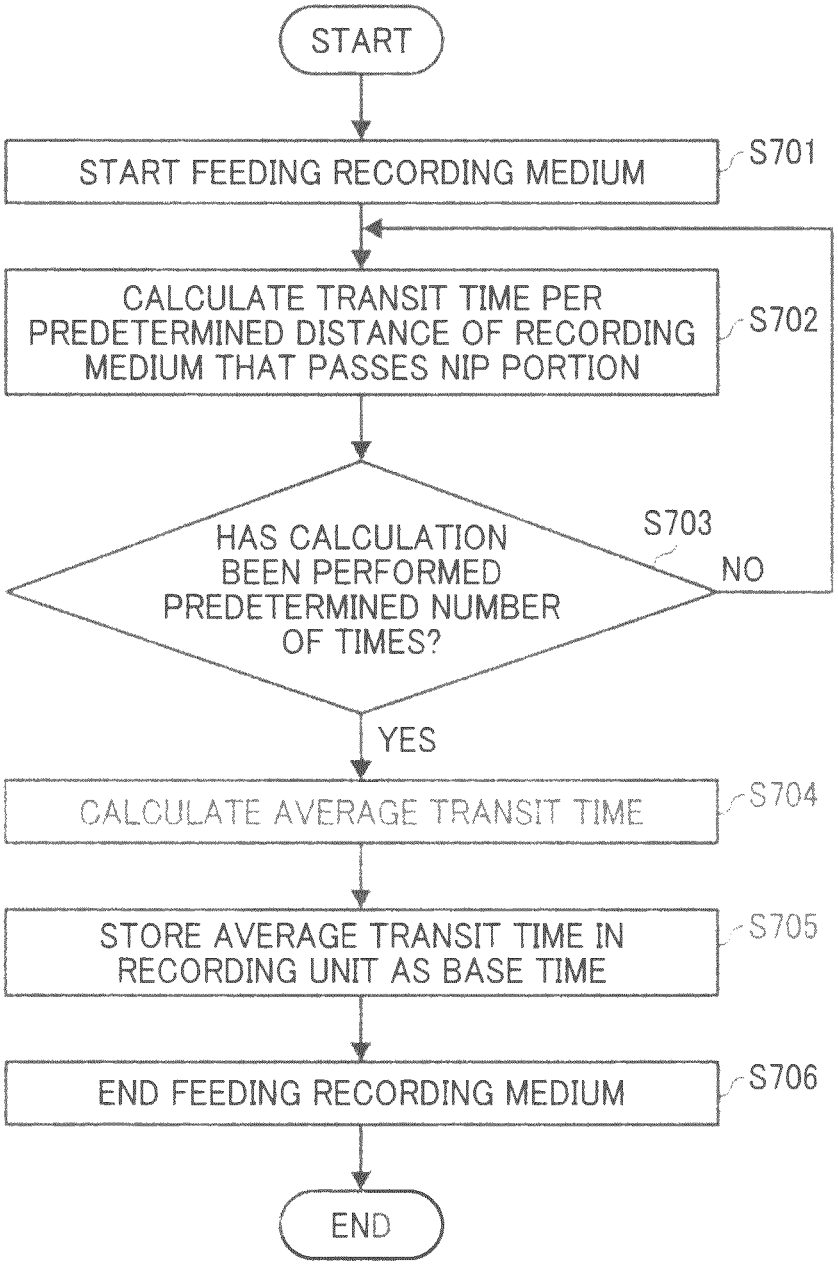
FIG. 7 is a flowchart of an example of processing performed by the control unit when operating in base time setting mode.

FIG. 7 is a flowchart of an example of processing performed by the control unit 21 in base time setting mode where the base time Tbase for use in calculating the nip width adjustment amount is stored in the storing unit 23. With reference to FIG. 7, the processing performed by the control unit 21 in the base time setting mode will be described.

The processing of FIG. 7 is started immediately after the nip width is adjusted to a predetermined value by mechanical adjustments in the factory before shipment of the color laser printer 100 or on the site where the product is delivered. The processing is started by the operator selecting the base time setting mode and operating the color laser printer 100. The base time setting mode is activated immediately after the nip width is adjusted to the predetermined value to store the transit time of the recording medium P passing through the nip portion over the predetermined distance in the storing unit 23 as the base time Tbase when the nip width is appropriate.

Starting the operation in the base time setting mode, the control unit 21 initially starts feeding the recording medium P (step S701). When the recording medium P starts being fed, the recording medium detection sensors 19*a* and 19*b* input their detection signals to the control unit 21 at timing when the trailing edge of the recording medium P passes the recording medium detection sensors 19*a* and 19*b* in the process of the recording medium P passing through the nip portion of the fixing device 11. The control unit 21 calculates the transit time of the recording medium P passing through the nip portion over the predetermined distance (the distance between the recording medium detection sensors 19*a* and 19*b*) on the basis of a time difference between when the recording medium detection sensors 19*a* and 19*b* detect the trailing edge of the recording medium P (step S702).

Next, the control unit 21 determines whether the transit time has been calculated at step S702 a predetermined number of times (step S703). If not (No at step S703), the control unit 21 repeats the calculation of the transit time at step S702 until the predetermined number of calculations are performed. On the other hand, if the transit time has been calculated the predetermined number of times (Yes at step S703), the control unit 21 calculates the average transit time for the predetermined number of times (step S704). For example, if the predetermined number of times is five and the transit times calculated are T1, T2, T3, T4, and T5, the average transit time Tave for the predetermined number of times is Tave=(T1+T2+T3+T4+T5)/5. The predetermined number of times may be set to one. If the predetermined number of times is set to one, the calculation of the average at step S704 is omitted.

Next, the control unit 21 stores the average Tave calculated at step S704 in the storing unit 23 as the base time Tbase (step S705). The control unit 21 then stops feeding the recording medium P (step S706), and ends the series of processing in the base time setting mode.

The foregoing processing in the base time setting mode is performed immediately after the nip width is adjusted to the predetermined value in the factory before shipment of the color laser printer 100 or on the site where the product is delivered. As mentioned previously, the processing in the base time setting mode may also be performed immediately after a change in the nip width is detected and the nip width is adjusted by the nip width adjusting mechanism 18. In such a case, the base time Tbase stored in the storing unit 23 is updated with the new value calculated by the processing that is performed immediately after the adjustment of the nip width by the nip width adjusting mechanism 18. Updating the base time Tbase after the adjustment of the nip width by the nip width adjusting mechanism 18 makes it possible to adjust the nip width to an appropriate value even if the fixing roller 15 undergoes an irreversible deformation with a variation in the nip width.

As has been described in detail in conjunction with specific examples, the fixing device 11 according to the present embodiment measures the transit time of the recording medium P passing through the nip portion over the predetermined distance. Based on the transit time of the recording medium P over the predetermined distance, the fixing device 11 adjusts the nip width by using the nip width adjusting mechanism 18. It is therefore possible to adjust the nip width to follow changes in the nip width accurately, thereby maintaining the nip width at an appropriate value for stable fixability. With the fixing device 11, the color laser printer 100 of the present embodiment can stably output high-quality printed matter.

It should be noted that the present invention is not limited to the foregoing embodiment, and various changes and modifications may be made without departing from the scope of the invention. For example, while the foregoing embodiment is described as being applied to the belt fixing device 11, it may be applicable to any other fixing device such as a roller fixing device. The foregoing embodiment is also described as being applied to the tandem color laser printer 100, it may be applicable to any image forming apparatus that includes a fixing device.

In the foregoing embodiment, the nip width adjusting mechanism 18 adjusts the nip width on the basis of the transit time of the recording medium P passing through the nip portion over the predetermined distance. The same effect as with the direct adjustment of the nip width can be obtained, however, even if other fixing conditions such as the fixing temperature (the amount of heat generated from the heater 20) and the rotating speed of the fixing roller 15 are adjusted on the basis of the transit time of the recording medium P passing through the nip portion over the predetermined distance. If the fixing condition to be adjusted is the fixing temperature, a need may arise to stop feeding the recording medium P until the fixing temperature reaches the target temperature. If the fixing condition to be adjusted is the rotating speed of the fixing roller 15, the productivity may drop due to a slower rotating speed of the fixing roller 15. In contrast, when the nip width is directly adjusted as in the foregoing embodiment, it is possible to stabilize the fixability of the fixing device 11 without such a drop in productivity.

According to an embodiment of the present invention, with respect to a recording medium passing through the nip portion, transit time per predetermined distance is measured, and the fixing condition is adjusted on the basis of the transit time. Thus, it is possible to optimize the fixing condition in response to a variation in nip width accurately, and stabilize the fixability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing roller that is driven to rotate;

a pressing member that is pressed against the fixing roller to form a nip portion;

a measuring unit that measures transit time taken for a recording medium passing through the nip portion to transit a predetermined distance; and an adjusting unit that adjusts a fixing condition based on the transit time measured by the measuring unit.

2. The fixing device according to claim 1, wherein the adjusting unit adjusts a position of the pressing member based on the transit time measured by the measuring unit to adjust a width of the nip portion as the fixing condition.

3. The fixing device according to claim 1, wherein the adjusting unit adjusts a fixing temperature as the fixing condition based on the transit time measured by the measuring unit.

4. The fixing device according to claim 1, wherein the adjusting unit adjusts a rotating speed of the fixing roller as the fixing condition based on the transit time measured by the measuring unit.

5. The fixing device according to claim 1, wherein the measuring unit includes at least two recording medium detection sensors that are arranged along a moving path of the recording medium at different positions on an upstream side of the nip portion.

6. The fixing device according to claim 5, wherein the recording medium detection sensors are arranged within a distance corresponding to a length of the recording medium of minimum size from an exit of the nip portion toward the upstream side of the moving path of the recording medium.

7. The fixing device according to claim 5, wherein the measuring unit measures the transit time from a time difference between when the recording medium detection sensors detect a trailing edge of the recording medium.

8. The fixing device according to claim 1, further comprising a storing unit that stores the transit time measured by the measuring unit as a base time when the nip portion is maintained at an appropriate width, wherein the adjusting unit adjusts the fixing condition by an amount of adjustment corresponding to a difference between the base time stored in the storing unit and the transit time measured by the measuring unit.

9. The fixing device according to claim 8, wherein the measuring unit measures the transit time after the fixing condition is adjusted by the adjusting unit, and updates the base time stored in the storing unit with a value measured.

10. The fixing device according to claim 1, further comprising a fixing belt that is stretched across the fixing roller and at least one roller, and heats and fuses a toner image on the recording medium to fix the toner image on the recording medium, wherein the pressing member is pressed against the fixing roller via the fixing belt to form the nip portion.

11. An image forming apparatus comprising a fixing device that includes:

a fixing roller that is driven to rotate;

a pressing member that is pressed against the fixing roller to form a nip portion;

a measuring unit that measures transit time taken for a recording medium passing through the nip portion to transit a predetermined distance; and an adjusting unit that adjusts a fixing condition based on the transit time measured by the measuring unit.

12. A method of controlling a fixing device including a fixing roller that is driven to rotate and a pressing member that is pressed against the fixing roller to form a nip portion, the method comprising:

measuring transit time taken for a recording medium passing through the nip portion to transit a predetermined distance; and adjusting a fixing condition based on the transit time.

* * * * *